US010858792B2

(12) United States Patent
McCallum

(10) Patent No.: US 10,858,792 B2
(45) Date of Patent: Dec. 8, 2020

(54) PAVEMENT MARKING CLEANING SYSTEM

(71) Applicant: Annihilator Cleaning Equipment, LLC, Fort Worth, TX (US)

(72) Inventor: Erick McCallum, Fort Worth, TX (US)

(73) Assignee: Annihilator Cleaning Equipment, LLC, Fort Worth, TX (US)

( * ) Notice: Subject to any disclaimer, the term of this patent is extended or adjusted under 35 U.S.C. 154(b) by 188 days.

(21) Appl. No.: 16/003,903

(22) Filed: Jun. 8, 2018

(65) Prior Publication Data

US 2019/0376245 A1 Dec. 12, 2019

(51) Int. Cl.

| | |
|---|---|
| ***E01H 1/10*** | (2006.01) |
| ***B08B 5/04*** | (2006.01) |
| ***B08B 3/02*** | (2006.01) |

(52) U.S. Cl.

CPC ..... *E01H 1/103* (2013.01); *B08B 3/024* (2013.01); *B08B 5/04* (2013.01)

(58) Field of Classification Search

CPC ..... E01H 1/103; B08B 5/04; B08B 3/024
IPC ..... E05H 1/10
See application file for complete search history.

(56) References Cited

U.S. PATENT DOCUMENTS

| | | | |
|---|---|---|---|
| 4,060,487 | A | 11/1977 | Samsel |
| 4,351,723 | A | 9/1982 | Palmer |
| 4,782,974 | A | 11/1988 | Elkayam |
| 4,862,551 | A | 9/1989 | Martinez |
| 5,224,236 | A | 7/1993 | Sallquist |
| 5,500,976 | A | 3/1996 | Rohrbacher |

(Continued)

FOREIGN PATENT DOCUMENTS

| | | | |
|---|---|---|---|
| EP | 2210982 | A1 | 7/2010 |
| EP | 2210982 | A2 | 7/2010 |
| FR | 2918085 | A1 | 6/2007 |

OTHER PUBLICATIONS

Search Report dated Aug. 26, 2019 for parent PCT application PCT/US2019/36326.

(Continued)

*Primary Examiner* — David Redding
(74) *Attorney, Agent, or Firm* — James E. Walton

(57) ABSTRACT

A system for using a fluid to clean markings on a hard surface includes a cleaning hood operably mounted on wheels for movement across the hard surface with the cleaning hood positioned immediately above the hard surface, a set of a plurality of cleaning arms of a selected length, the cleaning arms mounted for rotation under the cleaning hood and defining a cleaning area swept by the cleaning arms, a plurality of nozzles, each nozzle mounted on one of the plurality of cleaning arms, a cleaning fluid connection carried by the hood, the cleaning fluid connection configured to fluidly connect the nozzles and cleaning arms to a cleaning fluid supply, a vacuum connection carried by the hood, the vacuum connection configured to apply vacuum from a vacuum pump to remove contaminated cleaning fluid from the hard surface to a waste fluid storage tank, and a second set of a plurality of cleaning arms of a second selected length, wherein the plurality of cleaning arms of a selected length may be replaced by the second set of cleaning arms of a second selected length, altering the cleaning area swept by the cleaning arms.

14 Claims, 5 Drawing Sheets

(56) References Cited

U.S. PATENT DOCUMENTS

| | | | | |
|---|---|---|---|---|
| 5,706,548 | A * | 1/1998 | Schabacker | B08B 3/024 15/322 |
| 5,711,051 | A | 1/1998 | Roden | |
| 6,827,383 | B2 | 12/2004 | Lacy | |
| 6,896,742 | B2 | 5/2005 | Geyer et al. | |
| 7,735,186 | B1 | 6/2010 | Vogel | |
| 2003/0004079 | A1 | 1/2003 | Aigner | |
| 2005/0217708 | A1 | 10/2005 | Otterson | |
| 2007/0169305 | A1 | 7/2007 | Shea | |
| 2008/0141483 | A1 | 6/2008 | Pearlstein | |
| 2014/0010603 | A1 | 1/2014 | Blab | |

OTHER PUBLICATIONS

Search Report dated Oct. 22, 2014 for parent PCT application PCT/US2014/31748.
International Preliminary Examination Report dated Feb. 19, 2016 for parent PCT application PCT/US2014/31748.
Notice of Allowance dated Oct. 5, 2017 from corresponding U.S. Appl. No. 15/129,316.
Restriction Requirement dated Apr. 11, 2017 from corresponding U.S. Appl. No. 15/129,316.
Amendment dated Sep. 22, 2017 from corresponding U.S. Appl. No. 15/129,316.
Notice of Publication dated Apr. 13, 2017 from corresponding U.S. Appl. No. 15/129,316.
Office Action dated Jun. 22, 2017 from corresponding U.S. Appl. No. 15/129,316.
Final Office Action dated Aug. 16, 2012 from corresponding U.S. Appl. No. 12/460,745.
Amendment dated Oct. 28, 2013 from corresponding U.S. Appl. No. 12/460,745.
Response to Office Action dated Apr. 10, 2012 from corresponding U.S. Appl. No. 12/460,745.
Notice of Allowance dated Nov. 8, 2013 from corresponding U.S. Appl. No. 12/460,745.
Office Action dated Sep. 9, 2013 from corresponding U.S. Appl. No. 12/460,745.

* cited by examiner

PAVEMENT MARKING CLEANING SYSTEM

BACKGROUND

1. Field of the Invention

The present invention relates generally to environmentally friendly cleaning processes, and more specifically to a system and method for cleaning markings on pavement or other hard surfaces.

2. Description of Related Art

Commonly assigned U.S. Pat. Nos. 9,890,508 and 8,677,555 disclose a mobile cleaning system to be used for cleaning organic liquids from a hard surface that includes tanks for storing water, and for storing used, dirty water after cleanup. These systems use water pressure in excess of 3,500 p.s.i.

It has been determined that, in addition to more general pavement or surface cleaning needs, there is a need for systems adapted to clean pavement markings, such as center stripes and the like. Previously, when such markings became dull and non-reflective, they were re-painted or re-marked. But, such markings can be more economically cleaned and their life extended.

A need, exists, therefore, for improvements in systems and methods for cleaning markings on pavement or other hard surfaces.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
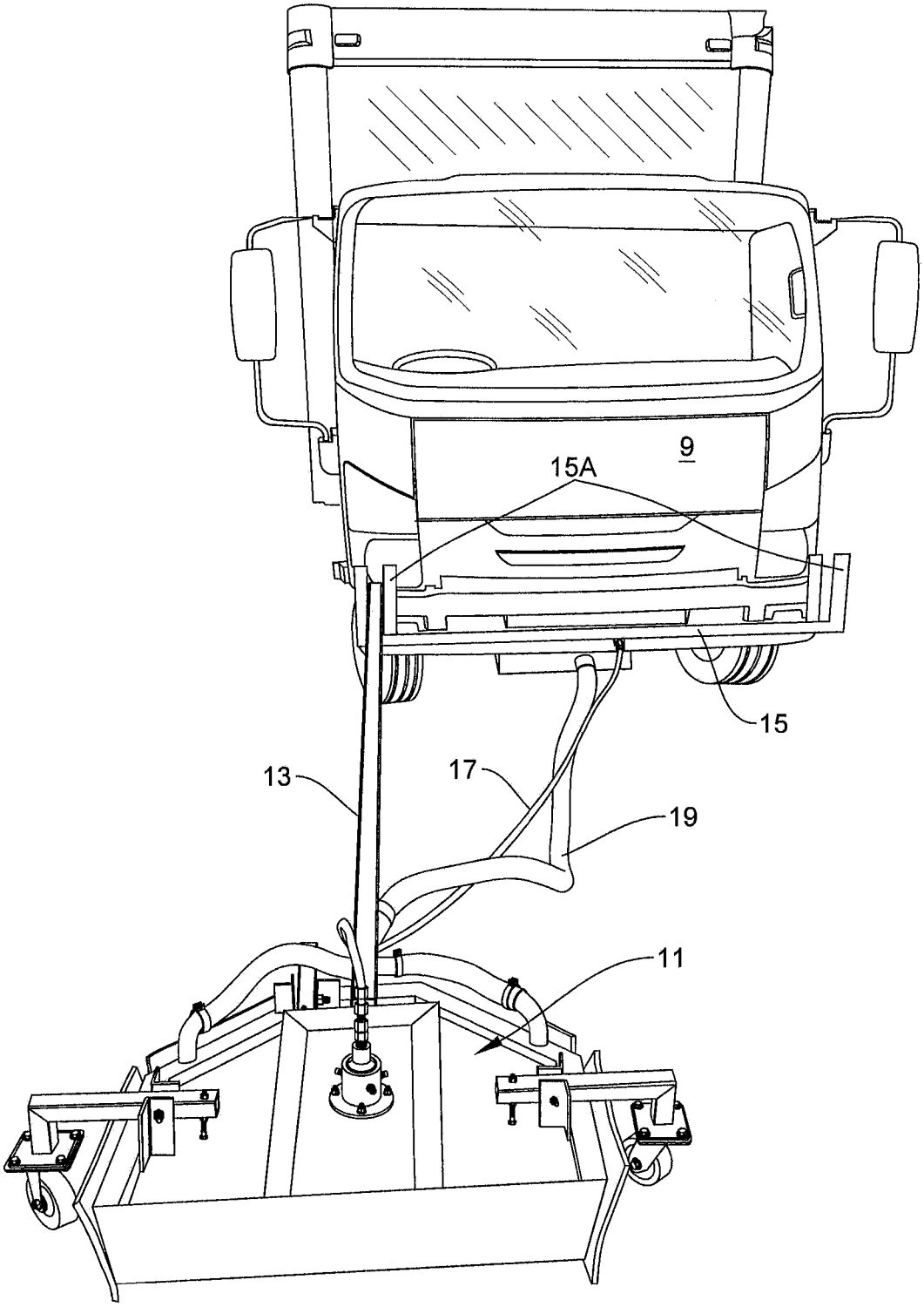
FIG. 1 is a perspective view of a cleaning system in accordance with an embodiment of the invention of the present application, mounted to a vehicle.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Referring now to the Figures, FIG. 1 depicts a pavement marking cleaning system and apparatus according to a preferred embodiment of the present application. A cleaning hood assembly 11 may be mounted by a boom 13 to the bumper of a vehicle 9 by a bracket 15. Bracket 15 may be provided with a pair of fixtures 15A at each end to which boom 13 may be pinned by a bolt or cotter pin so that the free end of boom, to which cleaning hood assembly 11 is secured, is free to move up and down, but is relatively constrained from lateral movement. Fixtures 15A on bracket 15 preferably may be located at the ends of bracket 15 to locate cleaning hood 11 near the center or edge of a roadway, but other positions may be desirable depending on the application. Boom 13 may affixed to cleaning hood 11 by a u-shaped bracket that is designed to "flex" to give some "shock-absorbing" capability to the mounting.

Vehicle 9 not only propels cleaning hood 11 up and down the pavement, but carries a supply of cleaning fluid and a waste fluid storage tank, along with positive-pressure and vacuum pumps and heaters as described in commonly assigned U.S. Pat. Nos. 9,890,508 and 8,677,555, which are incorporated herein by reference for all purposes. The system according to the present application may also be adapted to a "walk behind" unit, with the cleaning fluid supply, waste fluid tank, and pumps and heaters on a wheeled, portable unit.

A high-pressure fluid line 17 and a vacuum line 19 may extend from vehicle 9 to cleaning hood assembly 11 to provide pressurized cleaning fluid and vacuum to hood 11 through connections described below in connection with FIG. 2. Cleaning fluid may be pressurized water delivered at 5 to 5.5 gallons per minute from 3000 psi to 4500 psi and temperatures from cold to pure steam at 212 degrees Fahrenheit or higher. Pressure, temperature, and flow rate may all be adjusted for a particular application, but preferred cleaning parameters are 5 to 5.5 gallons per minute flow rate, at 3500 psi and 180 degrees F.

Figure 2:
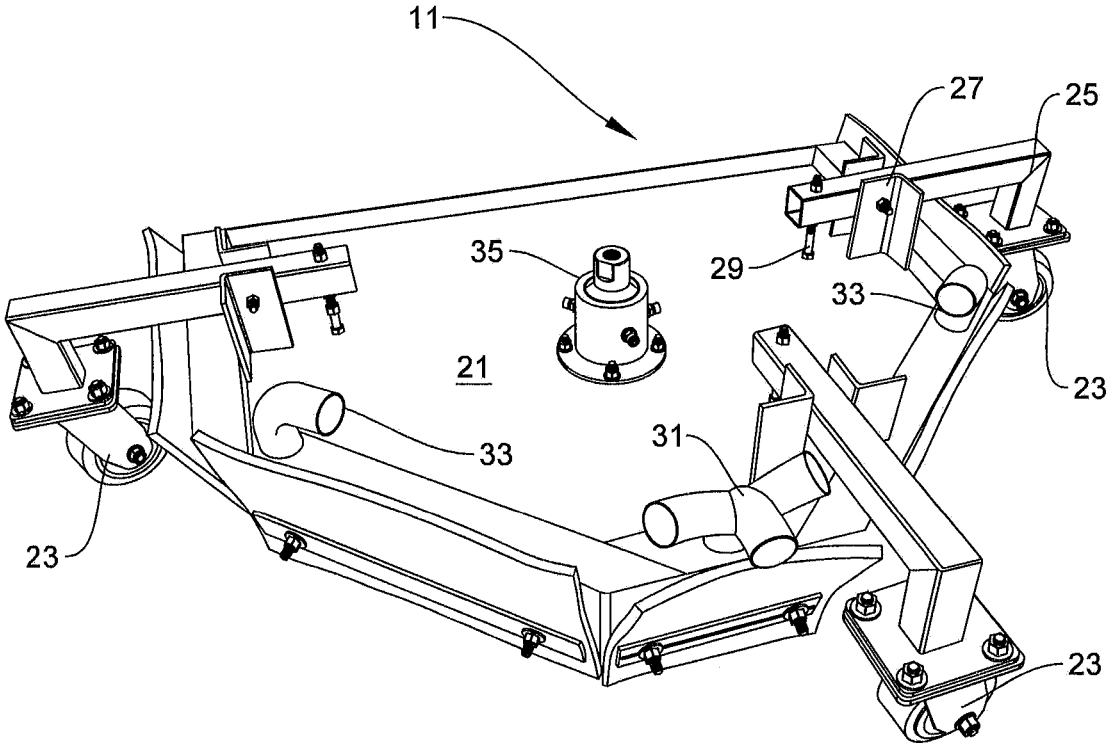
FIG. 2 is a top plan view of a cleaning hood portion of the cleaning system depicted in FIG. 1.
Figure 3:
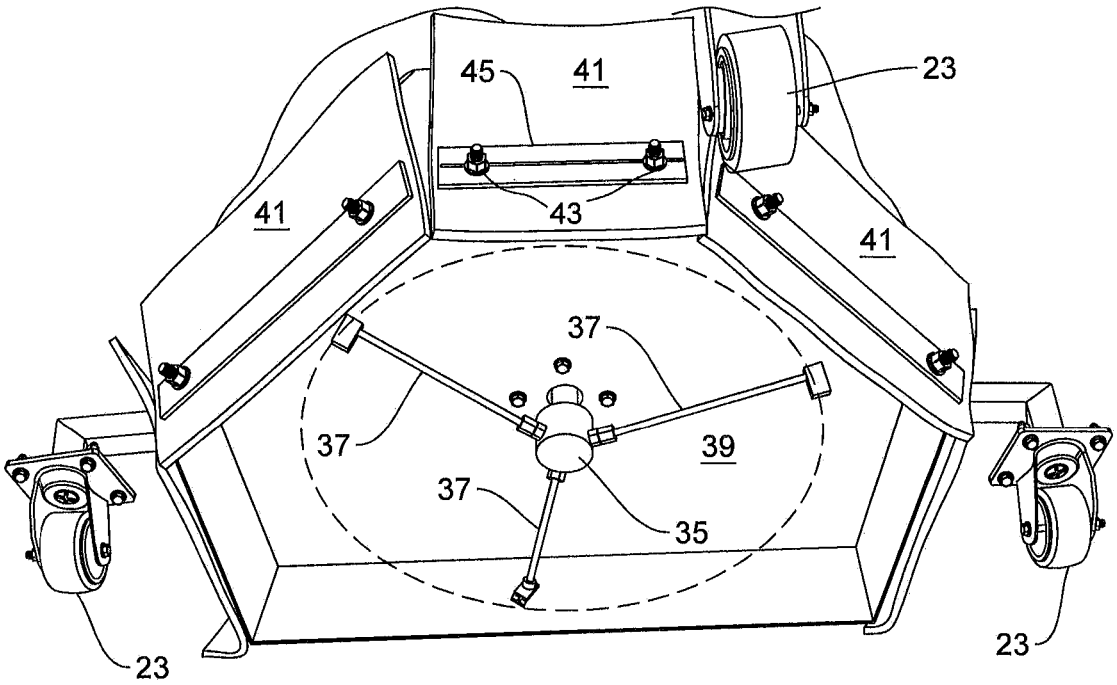
FIG. 3 is a bottom plan view of the cleaning hood of FIG. 2.

FIGS. 2 and 3 depict the cleaning hood assembly 11 of FIG. 1 in greater detail. Hood assembly 11 may comprise a stamped or welded sheet stainless steel or aluminum cleaning hood body 21 that is generally triangular in planform configuration, with downturned edges or sidewalls to form a hollow cavity on the underside. The upper edges of body may be reinforced by box members 21A. A plurality of wheels, in the form of casters 23, are mounted at each of the apices of hood body 21. Casters 23 may be free to rotate about their mounting axes, so that they can accommodate rolling movement of cleaning hood 11 in virtually any direction. Each caster 23 may be mounted to body 21 by an L-shaped member or beam 25, which is secured to the upper surface of body 21 by a pivot 27. A stop or adjustment bolt 29 may be provided on one side of pivot 27 opposite caster 23, thereby providing a height adjustment for each caster 23. By adjusting the height of bolt 29, the height of each caster 23 relative to body 21 may be adjusted, thereby adjusting the distance or height of hood body 21 and cleaning hood assembly 11 above the pavement.

A central, two-way, vacuum connector 31 may be mounted to the upper surface of body 21 to connect to vacuum line (19 in FIG. 1) to apply suction to the underside of hood body 21. Central vacuum connector 31 also attaches by vacuum lines to a pair of vacuum connectors 33 disposed at each of the lateral apices of hood body 21. Vacuum fixtures 31, 33 extend in fluid communication with the underside of hood body 21 and with vacuum line 19 to provide suction to the underside of body 21 to remove dirty, waste cleaning fluid and debris from under hood 21. The three vacuum connections 31, 33, roughly equally spaced about the trailing edges of hood 21, insure that consistent, even vacuum is applied at the rear sidewalls of body 21 to assist in complete removal of waste fluid and debris.

A pressure connector 35 is located on the central upper surface of body 21 and provides a connection for high-pressure line (17 in FIG. 1). Pressure connector 35 extends through body 21 to provide a rotating support and bearing for a plurality of spray arms 37. Preferably three spray arms 37 of selected length may be provided, each spray arm 37 mounting a plurality of nozzles 39 through which cleaning fluid is sprayed to clean the markings on pavement. Exit of cleaning fluid from nozzles 39 causes a reaction force, which causes the spray arms 37 to rotate about their center so that the arms sweep a circular area represented by the dashed line.

A flexible skirt surrounds the periphery or perimeter of hood body 21 and may be comprised of a plurality of sheets 41 of reinforced rubber. Each sheet 41 is secured to a downturned edge or sidewall of body 21 by a pair of bolts 43 and a metallic reinforcing strip 45. Each sheet 41 may be coextensive in length with a side of body 21 and together they define a skirt surrounding the perimeter or periphery of body 21. Bolts 43 may be loosened, and through oblong bolt holes in each sheet 41, the downward extension of sheets 41, and the skirt in totality, may be adjusted, along with wheels or casters 23, so that the skirt is in contact with or just above the pavement or other surface to be cleaned. This adjustment may be part of the initial "set up" of the hood assembly 11, or to compensate for wear of the skirt. The skirt at least partially prevents escape of pressurized fluid from underneath body 21 of cleaning hood 11 and assists in maintaining suction underneath hood 11 for removal of cleaning fluid and debris.

Figure 4:
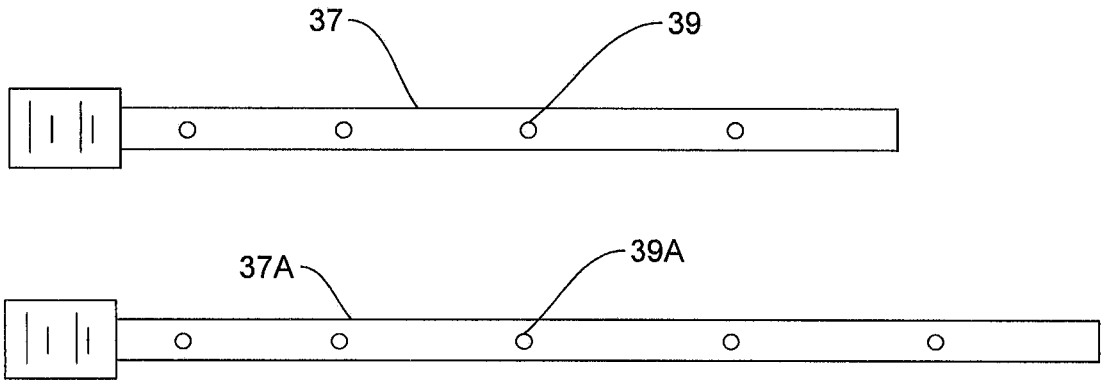
FIG. 4 is an elevation view of cleaning arms employed in the cleaning hood of FIGS. 2 and 3.

FIG. 4 depicts a pair of spray arms 37, 37A of differing length. A set of spray arms 37 of a given selected length may be replaced by a set of spray arms 37A of different selected length (typically all of the plurality of spray arms are replaced by a set of other spray arms) to alter the area or radius/diameter of the area swept by spray arms 37. Thus, if a relatively narrow pavement marking is to be cleaned (such as center stripes or lane stripes), cleaning fluid and energy may be preserved by installing a relatively shorter set of spray arms 37 sweeping a smaller area. Conversely, if a relatively large or wide marking is to be cleaned, a relatively longer set of spray arms 37A may be installed to reduce the number of "passes" over the marking to clean it. Typically, the number of spray nozzles 39, 39A varies in a linear fashion (defined, equal spacing) with the length of spray arms 37; however, the number of nozzles 39, 39A in a given length of spray arm 37, 37A may be varied to suit the application.

Figure 5:
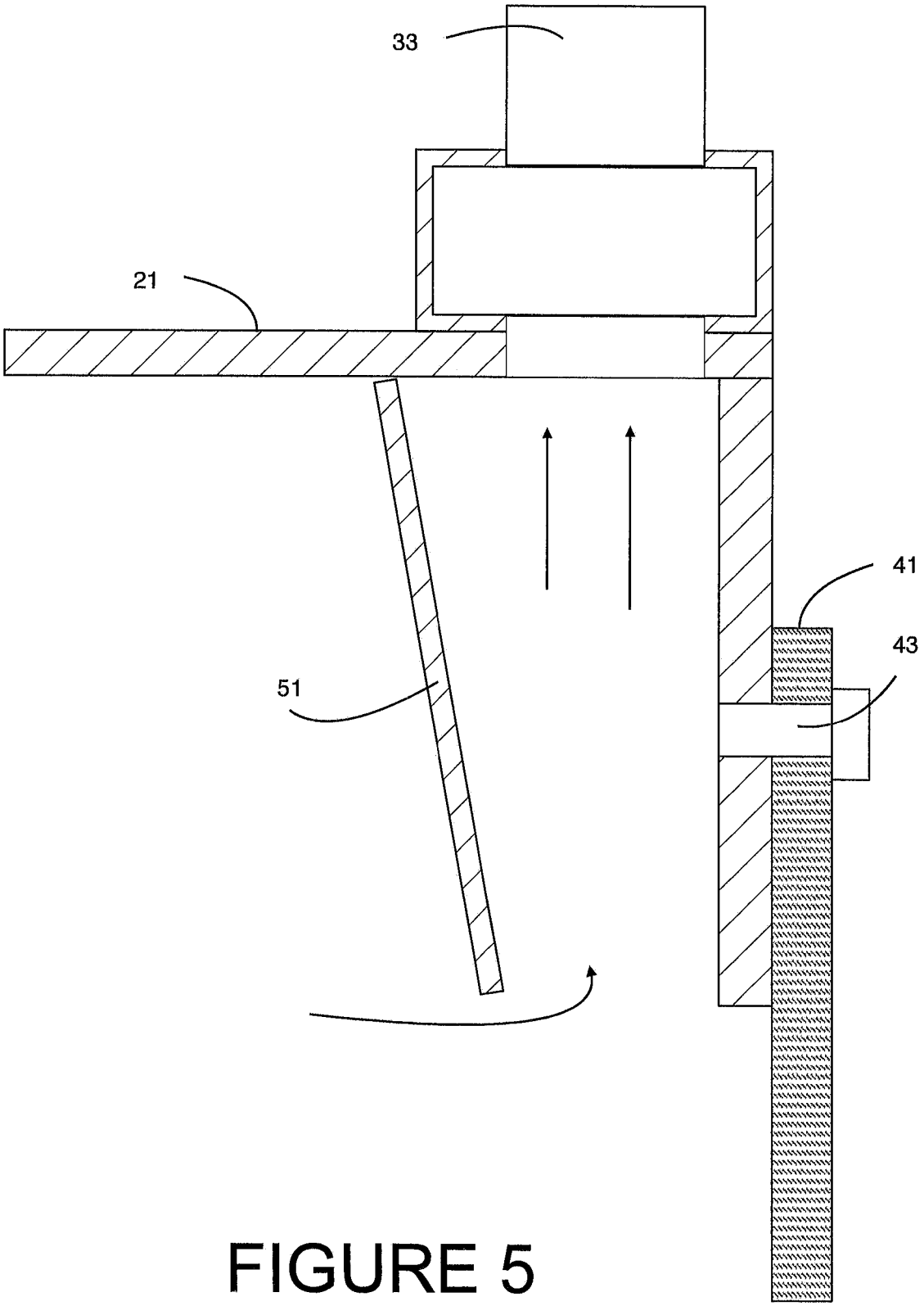
FIG. 5 is a fragmentary section view of a portion of the underside of the cleaning hood of FIG. 2, taken along the section line V-V of FIG. 2.

FIG. 5 depicts, in partial section taken along section line V-V of FIG. 2, a vacuum lip 51 on the underside of hood body 21 in accordance with a preferred embodiment of the present application. Lip 51 may be generally parallel with the sidewall of hood body 21, but inclined slightly toward it at an angle of 10-15 degrees. It may be spaced-apart from the sidewall by a distance slightly larger than the width of the opening of vacuum connector 33. Lip 51 may be slightly shorter than the sidewall of body 21 and skirt 41 so that suction applied by vacuum connector 33 (and vacuum line 19) may pass under the lower edge of lip 51. Lip 51 may be provided at the sides and rear of hood body 21 and concentrates vacuum or suction at the side and rear edges of body 21 to assist in preventing escape of cleaning fluid from underneath hood 21. Lip 51 is inclined toward the sidewall of body 21 to assist in preventing large debris from being suctioned into vacuum connection 33 and vacuum line 19.

In operation, cleaning hood assembly 11 is mounted to either the left or right side (or another location) of bracket 15 on vehicle 9, with vehicle located proximal the pavement marking to be cleaned. The height of casters 23 and skirt sheets 41 above the pavement may be adjusted. Vehicle 9 and hood assembly 9 are moved over the marking. Cleaning commences by supplying pressurized cleaning fluid through pressure line 19, to connection 35, and to spray arms 37, which spray the cleaning fluid onto the marking in an area swept by the arms. At the same time, vacuum or suction is applied to the underside of hood body 21 through vacuum line 21, and connections 31, 33 to remove waste cleaning fluid and debris from the sprayed marking.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

I claim:

1. A system for using a fluid to clean markings on a hard surface, the system comprising:

a cleaning hood operably mounted on wheels for movement across the hard surface with the cleaning hood positioned immediately above the hard surface;

a set of a plurality of cleaning arms of a first selected length, the cleaning arms mounted for rotation under the cleaning hood and defining a cleaning area swept by the cleaning arms;

a plurality of nozzles, each nozzle mounted on one of the plurality of cleaning arms;

a cleaning fluid connection carried by the hood, the cleaning fluid connection configured to fluidly connect the nozzles and cleaning arms to a cleaning fluid supply;

a vacuum connection carried by the hood, the vacuum connection configured to apply vacuum from a vacuum pump to remove contaminated cleaning fluid from the hard surface to a waste fluid storage tank; and a second set of a plurality of cleaning arms of a second selected length;

wherein the plurality of cleaning arms of a first selected length are of a different length than the second set of cleaning arms of a second selected length;

wherein the difference in length corresponds to additional or fewer nozzles of the plurality of nozzles; and wherein the plurality of cleaning arms of a first selected length may be replaced by the second set of cleaning arms of a second selected length, altering the cleaning area swept and sprayed by the cleaning arms.

2. The system of claim 1, further comprising:

a boom mounting the cleaning hood to a vehicle;

a cleaning fluid line extending between the cleaning fluid connection on the cleaning hood and the cleaning fluid supply carried by the vehicle; and a vacuum line extending between the vacuum connection on the cleaning hood and the vacuum pump and waste fluid storage tank carried by the vehicle.

3. The system of claim 1, further comprising:

a flexible skirt secured to a periphery of the cleaning hood, the flexible skirt extending downward into at least partial contact with the hard surface.

4. The system of claim 3, wherein the flexible skirt is adjustable to compensate for wear.

5. A system for using a cleaning fluid to clean markings on a hard surface, the system comprising:

a cleaning hood operably mounted on wheels for movement across the hard surface with the cleaning hood positioned immediately above the hard surface;

a set of a plurality of cleaning arms of a first selected length, the cleaning arms mounted for rotation under the cleaning hood and defining a cleaning area swept by the cleaning arms;

a plurality of nozzles, each nozzle mounted on one of the plurality of cleaning arms;

a cleaning fluid connection carried by the hood, the cleaning fluid connection configured to fluidly connect the nozzles and cleaning arms to a cleaning fluid supply;

a vacuum connection carried by the hood, the vacuum connection configured to apply vacuum from a vacuum pump to remove contaminated cleaning fluid from the hard surface to a waste fluid storage tank;

a second set of a plurality of cleaning arms of a second selected length;

wherein the plurality of cleaning arms of a first selected length are of a different length than the second set of cleaning arms of a second selected length;

wherein the difference in length corresponds to additional or fewer nozzles of the plurality of nozzles; and wherein the plurality of cleaning arms of a first selected length may be replaced by the second set of cleaning arms of a second selected length, altering the cleaning area swept and sprayed by the cleaning arms; and a flexible skirt secured to a periphery of the cleaning hood, the flexible skirt extending downward into at least partial contact with the hard surface.

6. The system of claim 5, further comprising:

a boom mounting the cleaning hood to a vehicle;

a cleaning fluid line extending between the cleaning fluid connection on the cleaning hood and the cleaning fluid supply carried by the vehicle; and a vacuum line extending between the vacuum connection on the cleaning hood and the vacuum pump and waste fluid storage tank carried by the vehicle, wherein the cleaning fluid supply and waste fluid storage tank are maintained separate.

7. The system of claim 5, wherein the flexible skirt is adjustable to compensate for wear.

8. The system of claim 7, wherein the skirt comprises:

a plurality of flexible sheets, each of the flexible sheets generally coextensive with a side of the cleaning hood; and at least one fastener securing each flexible sheet to the cleaning hood, wherein the fastener is loosed to adjust the flexible sheet;

wherein the adjustment of the flexible sheet comprises an adjustment to a dimension that is relative to the hard surface.

9. The system of claim 1, wherein altering the cleaning area swept and sprayed by the cleaning arms comprises altering increasing a number of the plurality of nozzles mounted on at least one of the plurality of cleaning arms.

10. The system of claim 5, wherein altering the cleaning area swept and sprayed by the cleaning arms comprises altering increasing a number of the plurality of nozzles mounted on at least one of the plurality of cleaning arms.

11. The system of claim 9, wherein the first selected length is greater than the second selected length.

12. The system of claim 11, wherein the number of the plurality of nozzles corresponds to a length of a cleaning arm.

13. The system of claim 10, wherein the first selected length is greater than the second selected length.

14. The system of claim 13, wherein the number of the plurality of nozzles varies with a length of a cleaning arm.

* * * * *